US007845621B1

(12) United States Patent
Lu

(10) Patent No.: US 7,845,621 B1
(45) Date of Patent: Dec. 7, 2010

(54) TIGHTENER FOR A BINDING STRAP

(76) Inventor: Jung-Wen Lu, No. 749, Renhua Rd., Dali City (TW) 412

( * ) Notice: Subject to any disclaimer, the term of this patent is extended or adjusted under 35 U.S.C. 154(b) by 0 days.

(21) Appl. No.: 12/543,460

(22) Filed: Aug. 18, 2009

(51) Int. Cl.
*B66F 3/00* (2006.01)
*B21F 9/00* (2006.01)
*A43C 11/00* (2006.01)

(52) U.S. Cl. ..... 254/218; 254/223; 254/237; 254/239; 24/69 CT; 24/68 CD

(58) Field of Classification Search ..... 254/213, 254/217, 218, 222, 223, 237, 243, 244, 238, 254/239; 24/68 CD, 69 CT, 69 ST, 70 ST
See application file for complete search history.

(56) References Cited

U.S. PATENT DOCUMENTS 6,457,701 B1 * 10/2002 Huang ..... 254/217
6,665,910 B2 * 12/2003 Huang ..... 24/68 CD
6,729,604 B1 * 5/2004 Claycomb ..... 254/217
6,824,121 B2 * 11/2004 Boice ..... 254/223
6,880,810 B1 * 4/2005 Hu ..... 254/218
6,966,543 B2 * 11/2005 Loudamy ..... 254/243
7,069,623 B2 * 7/2006 Lu ..... 24/68 CD
7,413,170 B2 * 8/2008 Ruan ..... 254/244
7,416,167 B1 * 8/2008 Knox ..... 254/223
7,464,915 B2 * 12/2008 Liu et al. ..... 254/217
7,472,890 B2 * 1/2009 Huang ..... 254/223
2006/0042052 A1 * 3/2006 Lu ..... 24/68 CD
2006/0091368 A1 * 5/2006 Im ..... 254/218
2006/0169956 A1 * 8/2006 Bitterolf ..... 254/217
2007/0221897 A1 * 9/2007 Cardona ..... 254/218
2007/0267611 A1 * 11/2007 Leone et al. ..... 254/218

* cited by examiner

*Primary Examiner*—Evan H Langdon
(74) *Attorney, Agent, or Firm*—Wang Law Firm, Inc.; Li K. Wang

(57) ABSTRACT

A tightener for a binding strap is disclosed. A base is penetrated with a rotating axle with a ratchet installed on its one end. A tooth limits the ratchet to move in a single direction. A driving element is mounted on the rotating axle. A ratchet tooth engages with the ratchet for the driving element to drive the ratchet. The driving element has a cam part and a blocking part.

10 Claims, 15 Drawing Sheets

TIGHTENER FOR A BINDING STRAP

BACKGROUND OF THE INVENTION

1. Field of Invention

The invention relates to a tightener for a binding strap and, in particular, to a device that tightens a binding strap.

2. Related Art

FIG. 13 shows a conventional tightening structure for a binding strap. It includes a base 8 having an axle hole 811 on each of its two sides for a rotating axle 82 to go through. One end of the axle 82 is connected with a driving element 83 that has several through holes 84. The body of the axle 82 has a long cutting groove 85 for a binding strap to go through. The rotating axle 82 is provided with a single-direction ratchet 87 on the outer side of the base. A stopping block 88 is disposed above the ratchet 87 and on the outer side of the base 8 to function with the ratchet 87.

The above-mentioned tightener has one acting bar (not shown) inserting into the through hole 84 of the driving element 83. By rotating the driving element 83, the axle 82 is driven to gradually tighten the binding strap 86. To release it, one has to depart the stopping block 88 away from the teeth of the ratchet 87. In this case, the axle can rotate freely and one can readily pull out the binding strap 86. However, it is not easy to move the stopping block 88 away when the ratchet 87 tightly snaps the binding strap. One has to exert a force on the acting bar toward the driving direction in order for the ratchet 87 to slightly relax for the user to relieve the stopping block 88. This shows its inconvenience and danger in uses.

To solve the above-mentioned problem with the conventional tightener, there is another design of the tightening structure for the binding strap in the prior art. As shown in FIGS. 14 and 15, it includes a base 9 having an axle hole 91 on each of the two sides. A rotating axle 92 goes through the two axle holes 91. The rotating axle 92 has a long groove 93 for the binding strap to go through. One end of the rotating axle 92 is connected with a driving element 94. The driving element 94 has several through holes 941, a swinging arm 942 and a cam part 943. The swinging arm 942 has an engaging block 944. The cam part 943 has a stopping block 945. The rotating axle 92 has a ratchet 95 on the outer side of the base 9. On the outer side of the base 9 and above the ratchet 95, there is a tooth 96 engaging with the ratchet 95.

When operating the above-mentioned tightener, the user inserts an acting bar (not shown) into one through hole 941 of the driving element 94. By moving the driving element 94 reciprocally in the vertical direction, the engaging block 944 rotates the rotating axle 92 of the ratchet in a single direction. The tooth 96 prevents the ratchet from rotating backwards. This gradually tightens the binding strap. To release the binding strap, the user has to depart the engaging block 944 from the ratchet 95. By rotating the driving element 94 now, the cam part 943 pushes the tooth 96 away from the ratchet 95. This relieves the binding strap.

Nonetheless, the second conventional tightener has more complicated structure and components. This renders higher component and assembly costs. The tighteners thus produced are more expensive and less attractive to consumers. It is an objective of the invention to solve these problems.

SUMMARY OF THE INVENTION

In view of the foregoing, the invention provides a tightener for a binding strap that can simplify its components and reduce the production cost.

To achieve the above-mentioned objective, the invention includes a base, a ratchet and a driving element for driving the ratchet wheel.

The base has two opposite sidewalls, each of which has an axle hole. A rotating axle goes through the axle holes of the two sidewalls. The ratchet is fixed on the rotating axle protruding from the sidewall of the base. The sidewall opposite to the ratchet is pivotally installed with a tooth that engages and limits the ratchet to rotate in a single direction. The width of the ratchet is smaller than that of the tooth. The ratchet and the tooth engage with each other on the inner side near the sidewall. The rotating axle has a long cutting groove in the base for the binding strap to go through.

When driving, the driving element is coaxially mounted on the end of the rotating axle on the outer side of the ratchet. The driving element is pivotally provided with a ratchet tooth engaging with the ratchet. The driving element is protruded with a holding part for imposing a force. A cam part is provided to disengage the tooth and the ratchet. When the cam part is functioning, it urges against the outer side of the tooth relative to the thickness of the ratchet. The end of the driving element opposite to the holding part has a blocking part that blocks the tooth in the driving direction.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

Figure 1:
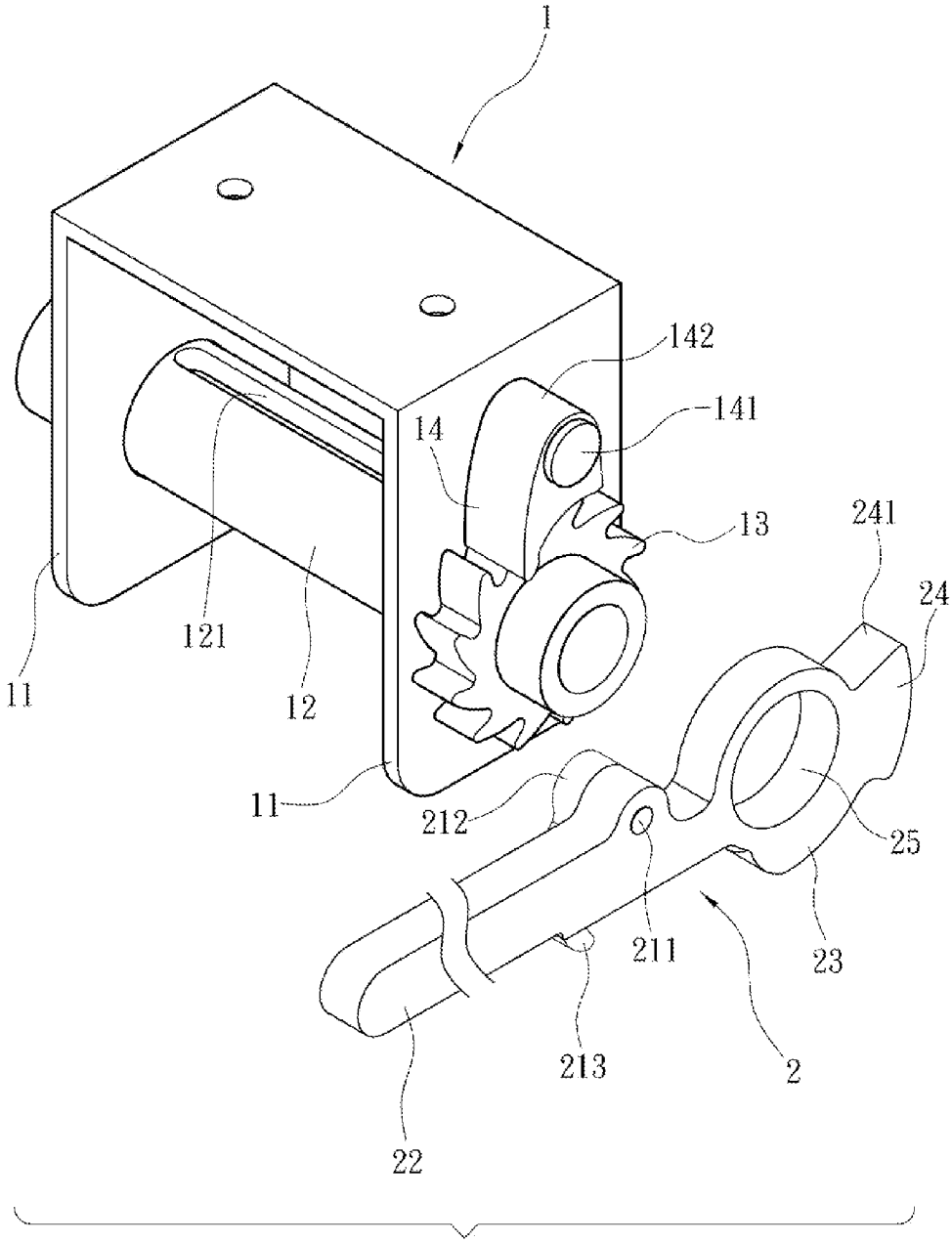
FIG. 1 is a three-dimensional assembly view of the invention.
Figure 2:
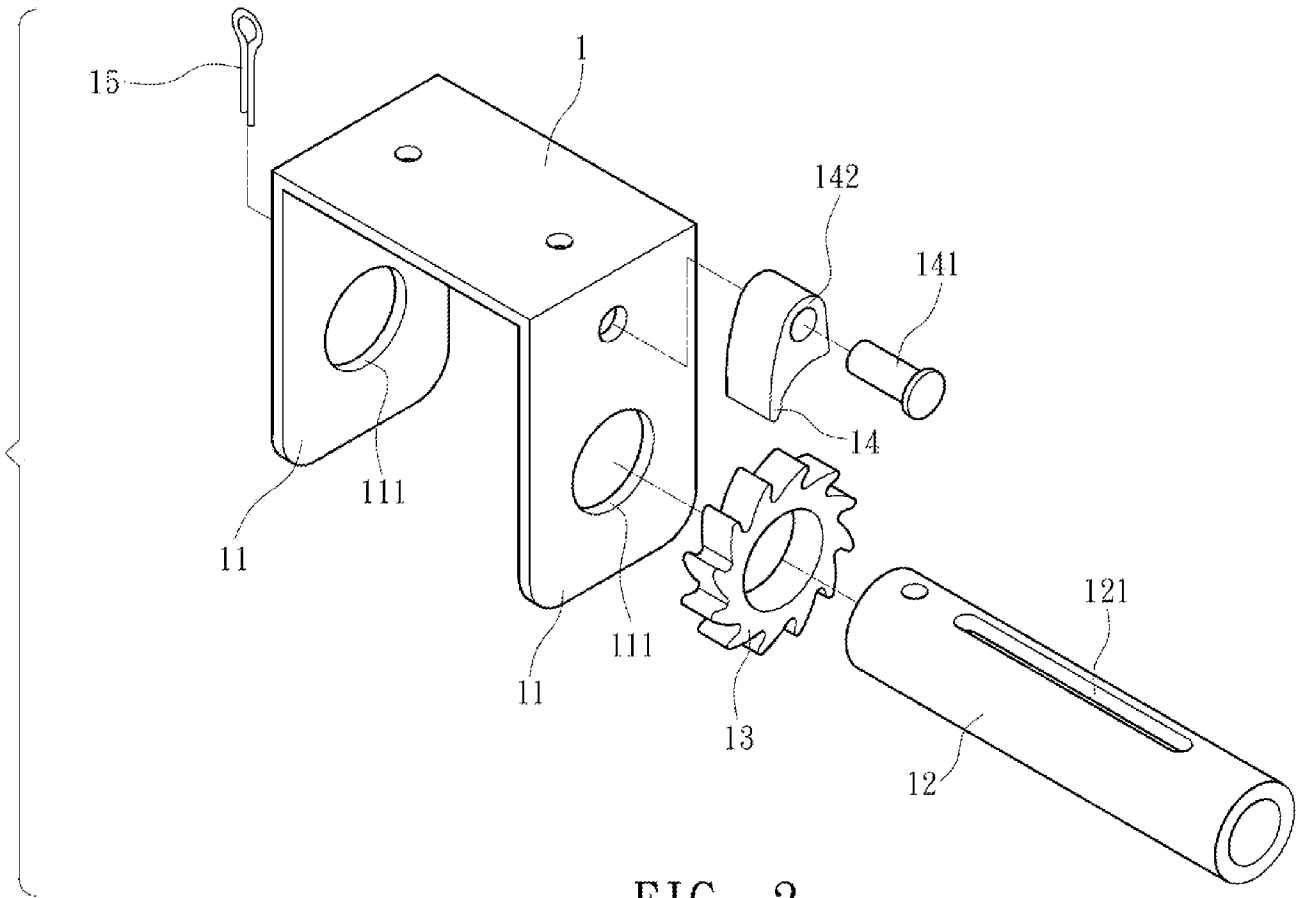
FIG. 2 is a three-dimensional exploded view of the base in the invention.
Figure 3:
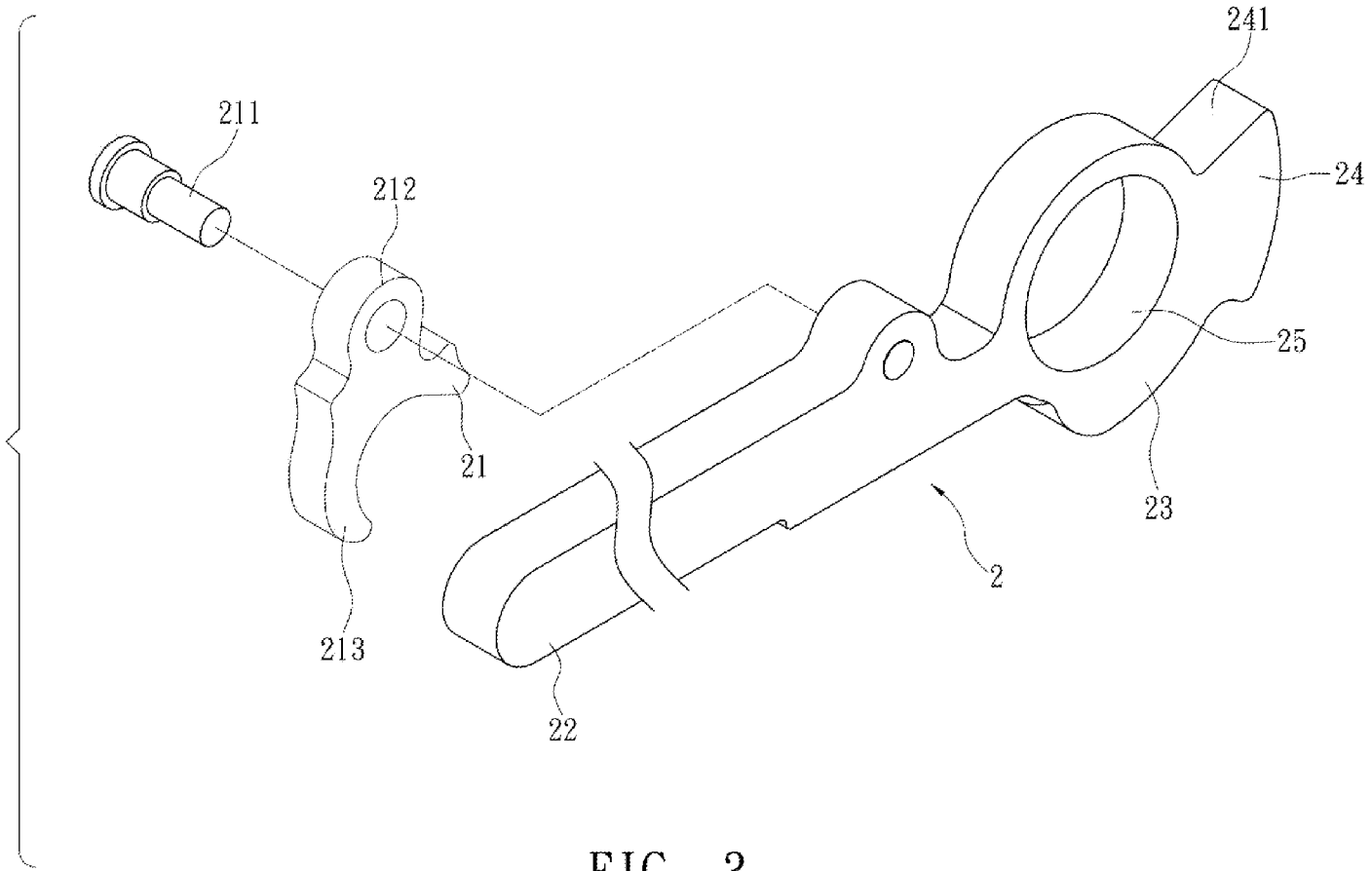
FIG. 3 is a three-dimensional exploded view of the driving element in the invention.
Figure 4:
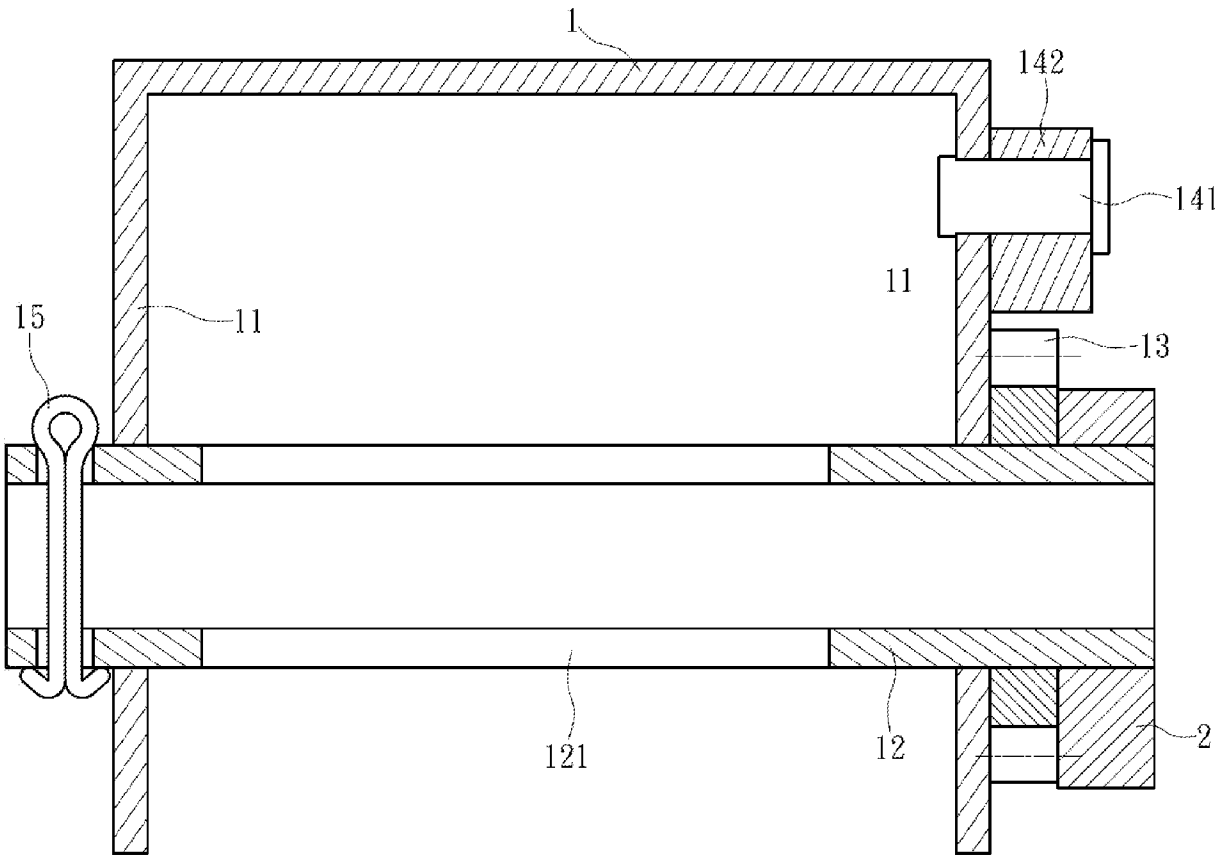
FIG. 4 is a cross-sectional view of the invention.

The present invention will be apparent from the following detailed description, which proceeds with reference to the accompanying drawings, wherein the same references relate to the same elements.

Please refer to FIGS. 1 to 4 for a first embodiment of the invention. This embodiment is for the illustration purpose and should not be used to constrain the scope of the invention.

This embodiment provides a tightener for a binding strap that includes a base 1 and a driving element 2.

The base 1 has two opposite sidewalls 11, each of which has an axle hole 111. A rotating axle 12 goes through the axle holes 111 of the two sidewalls 11. A ratchet 13 is mounted on the rotating axle 12 protruding from the sidewall 11 of the base 1. A tooth 14 is provided on the sidewall 11 above the ratchet 13. This tooth 14 engages by its inner side with and limits the ratchet 13 to rotate in a single direction. The rotating axle 12 in the base 1 has a long cutting groove 121 for the insertion of the binding strap.

In this embodiment, the rotating axle 12 is fixed on the other end of the ratchet 13. One limiting element 15 goes through the rotating axle 12 outside the sidewall 11 of the base 1. It restricts the rotating axle 12 within the axle holes 111 of the two sidewalls 11.

The driving element 2 drives the ratchet 13 to rotate. When the driving element 2 is driving, it is coaxially mounted on the end of the rotating axle 12 on the outer side of the ratchet 13. The driving element 2 is pivotally provided with a ratchet tooth 21 that engages with the ratchet 13. The driving element 2 is extended outwards with a holding part 22 for the exertion of a force. A cam part 23 is provided to push the tooth 14 so that the tooth 14 disengages with the ratchet 13. The other end opposite to the holding part 22 of the driving element has a blocking part 24. The blocking part 24 blocks the tooth 14 in the driving direction of the driving element 2.

The width of the ratchet 13 in this embodiment is smaller than that of the tooth 14. As the cam part 23 pushes, it urges against the outer side of the tooth 14 relative to the ratchet 13.

In this embodiment, the driving element 2 has a mounting part 25 between the blocking part 24 and the ratchet 21. The driving element 2 is coaxially mounted on the rotating axle 12 by the mounting part 25. The cam part 23 is disposed on the side of the mounting part 25 between the ratchet 21 and the blocking part 24. The mounting part 25 in this embodiment is a through hole. The driving element 2 is mounted on the outer ring of the rotating axle 12 by this mounting part 25 (e.g., the through hole).

A pivotal bar 141 protrudes from the sidewall 11 with the ratchet 13 on the base 1 in this embodiment. The tooth 14 is pivotally connected with the pivotal bar 141 using a pivotal part 142. The tooth 14 engages with the ratchet by its inner side. Its outer side is urged by the cam part 23 when the cam part 23 pushes. When the driving part 2 is driving, the end surface 241 of the blocking part 24 stops at the side edge of the pivotal part 142 of the tooth 14.

According to this embodiment, the driving element 2 has a pivotal bar 211. The ratchet tooth 21 is pivotally connected with the pivotal bar 211 by a pivotal part 212. A pulling part 213 extends from the ratchet tooth 21, having a weight larger than that of the ratchet tooth 21. The pulling part 213 swings downwards by its own weight. At the downward position of the pulling part 213, the ratchet tooth 21 protrudes towards and engages with the ratchet 13.

Figure 5:
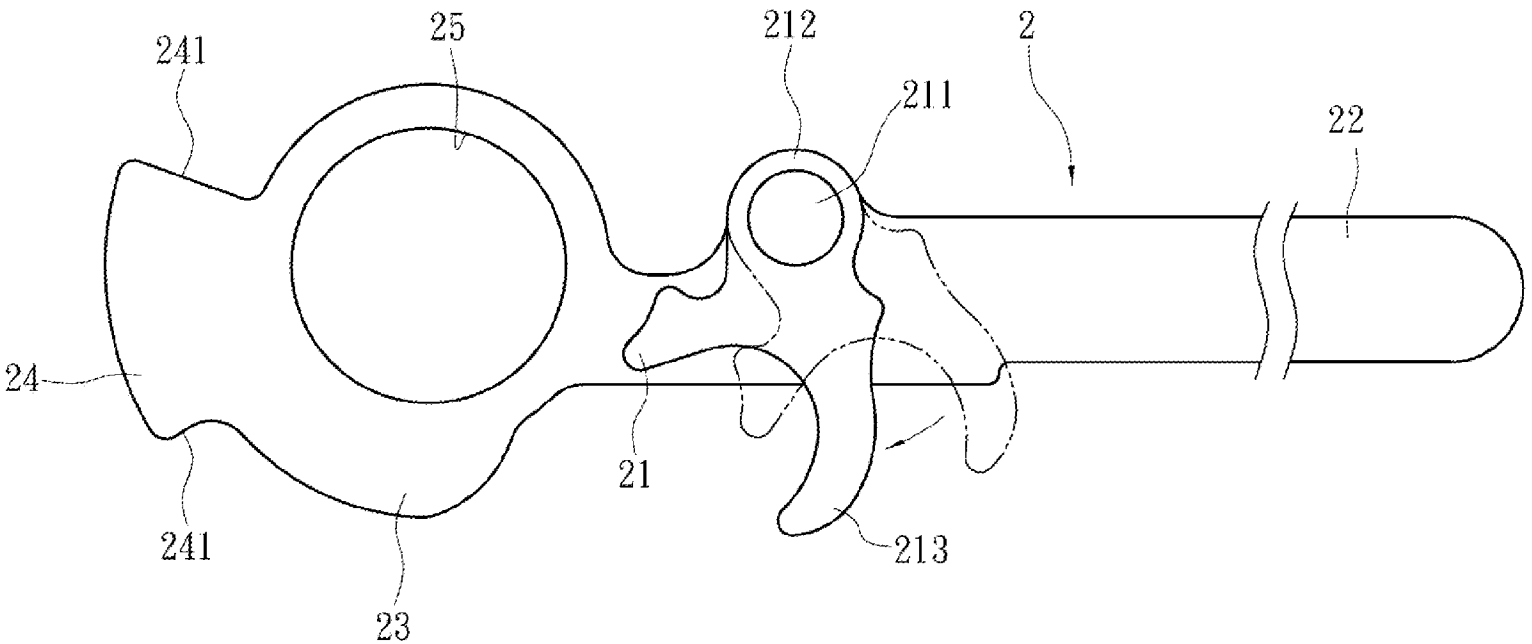
FIG. 5 is a schematic view when the ratchet tooth of the invention swings downwards.

As shown in FIG. 5, the pulling part 213 has a weight larger than the ratchet tooth 21. Due to the gravity, the pulling part 213 is normally downwards. Therefore, the ratchet tooth 21 protrudes forwards relative to the pulling part 213. The ratchet tooth 21 is pulled upwards as the ratchet 13 rotates. When it escapes from the ratchet 13, its drops by its own gravity. Therefore, it can slide among the teeth of the ratchet 13.

Figure 6:
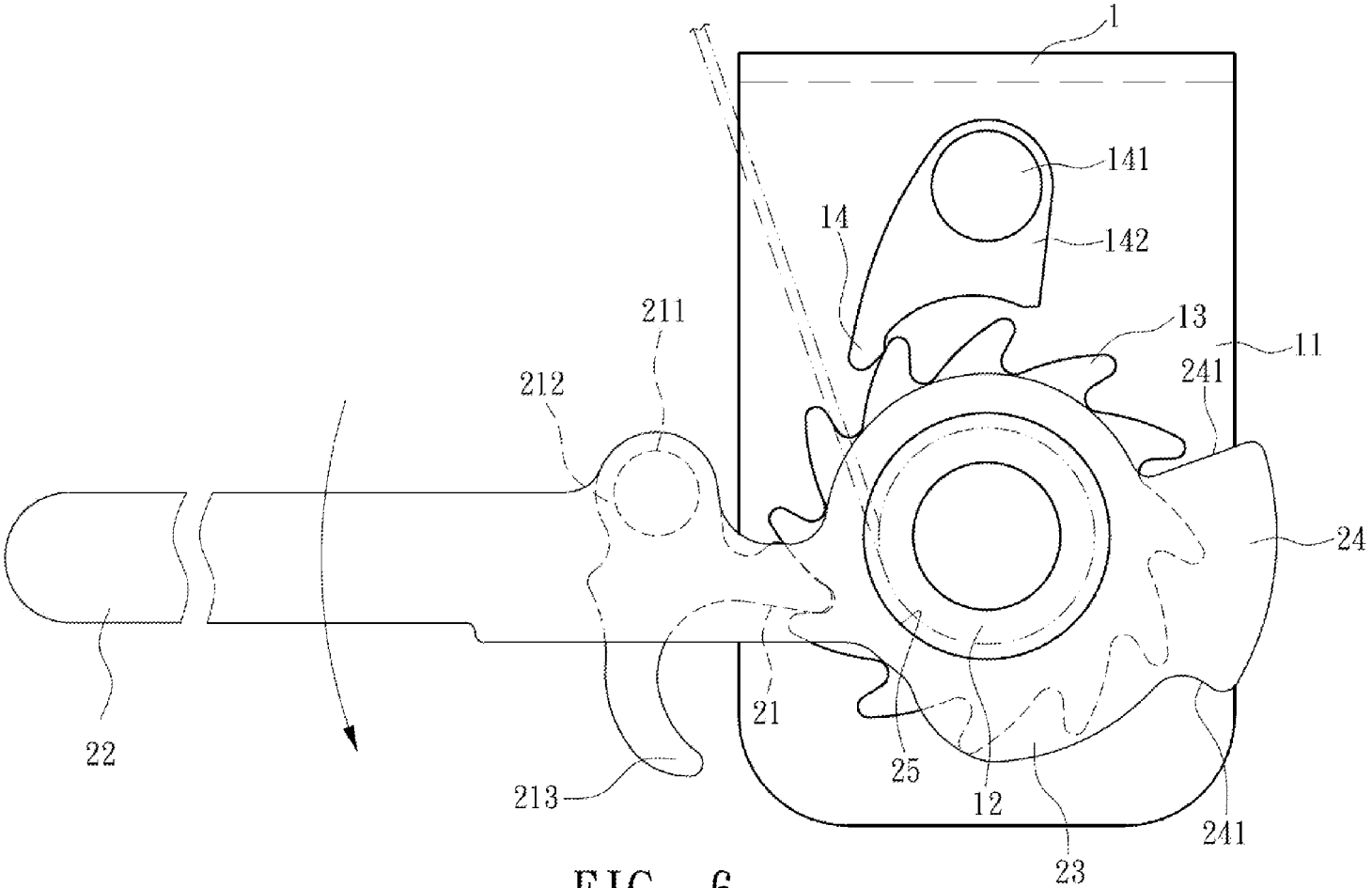
FIG. 6 is a schematic view of tightening the binding strap.
Figure 7:
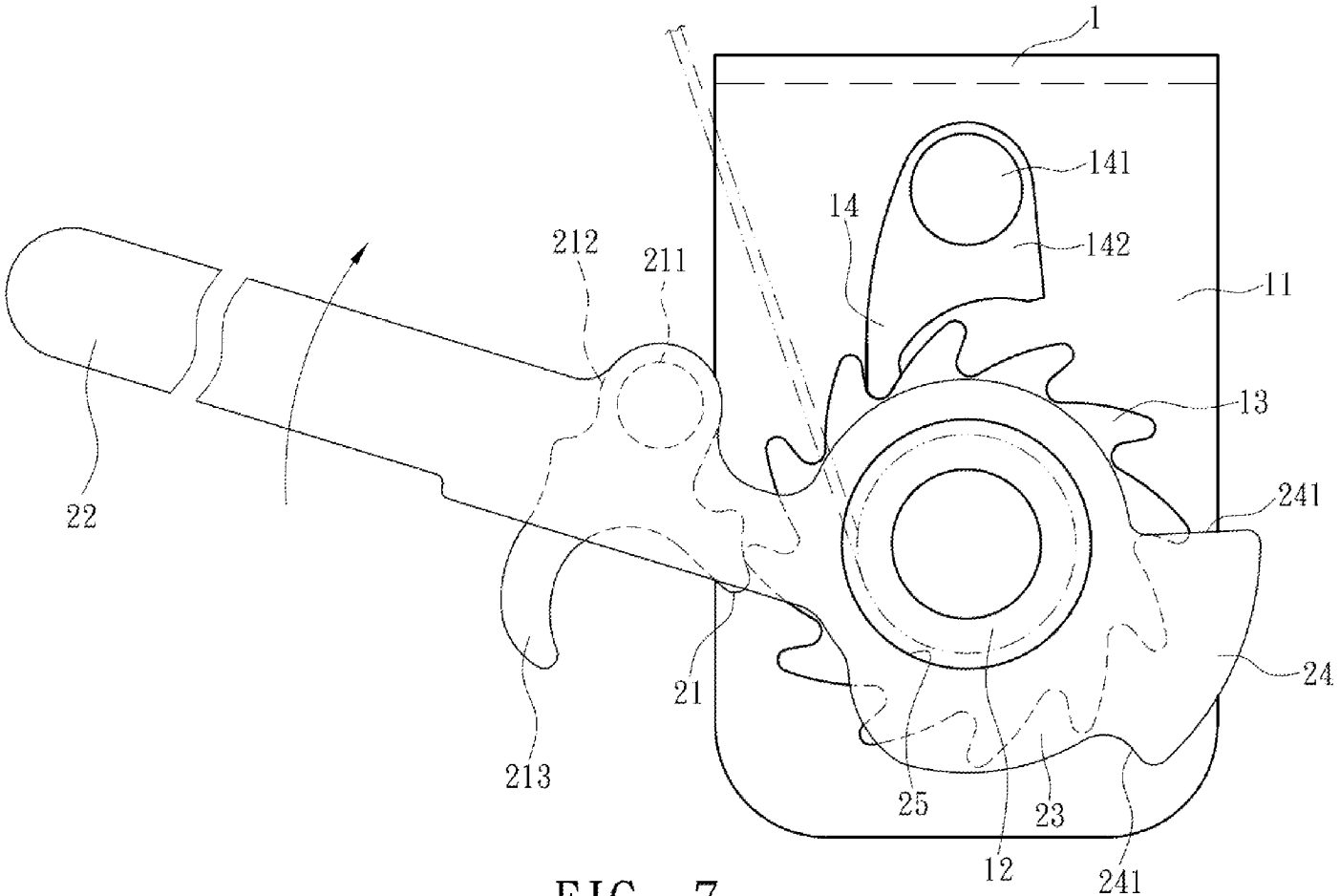
FIG. 7 is a schematic view of the driving element being pushed upwards.

The operating principle of the disclosed tightener is to mount the driving element 2 on the rotating axle 12 by its mounting part 25 (through hole). The pulling part 213 enables the ratchet tooth 21 to engage with the ratchet 13. In this case, the holding part 22 on the driving element 2 forms a force arm. As shown in FIG. 6, when the holding part 22 is pulled downwards, the ratchet tooth 21 on the driving element 2 pushes the ratchet 13, so that the ratchet 13 starts to rotate. In this case, the tooth 14 jumps from tooth to tooth and engages with the ratchet 13 as the ratchet 13 rotates. The tooth 14 prevents the ratchet 21 from rotating backwards. As shown in FIG. 7, when the holding part 22 is pulled downwards to some extent, it can be pulled upwards again. In this case, the ratchet tooth 21 of the driving element 21 goes back to the upper position of the ratchet 2. The user can again pull down the holding part 22 now. By repeating the above-mentioned actions, the invention gradually tightens the binding strap on the rotating axle 12.

The cam part 23 faces downwards relative to the holding part 22. To prevent the tooth 14 from being pushed away from the ratchet 13 due to over-pulling the driving element 2, during the process of tightening the binding strap the driving element 2 is restricted to rotate within certain angles. This is achieved by pushing the edge of the cam part 23 to the side edge of the pivotal part 142 of the tooth when the holding part 22 of the driving element 2 rotates to some angle.

Figure 8:
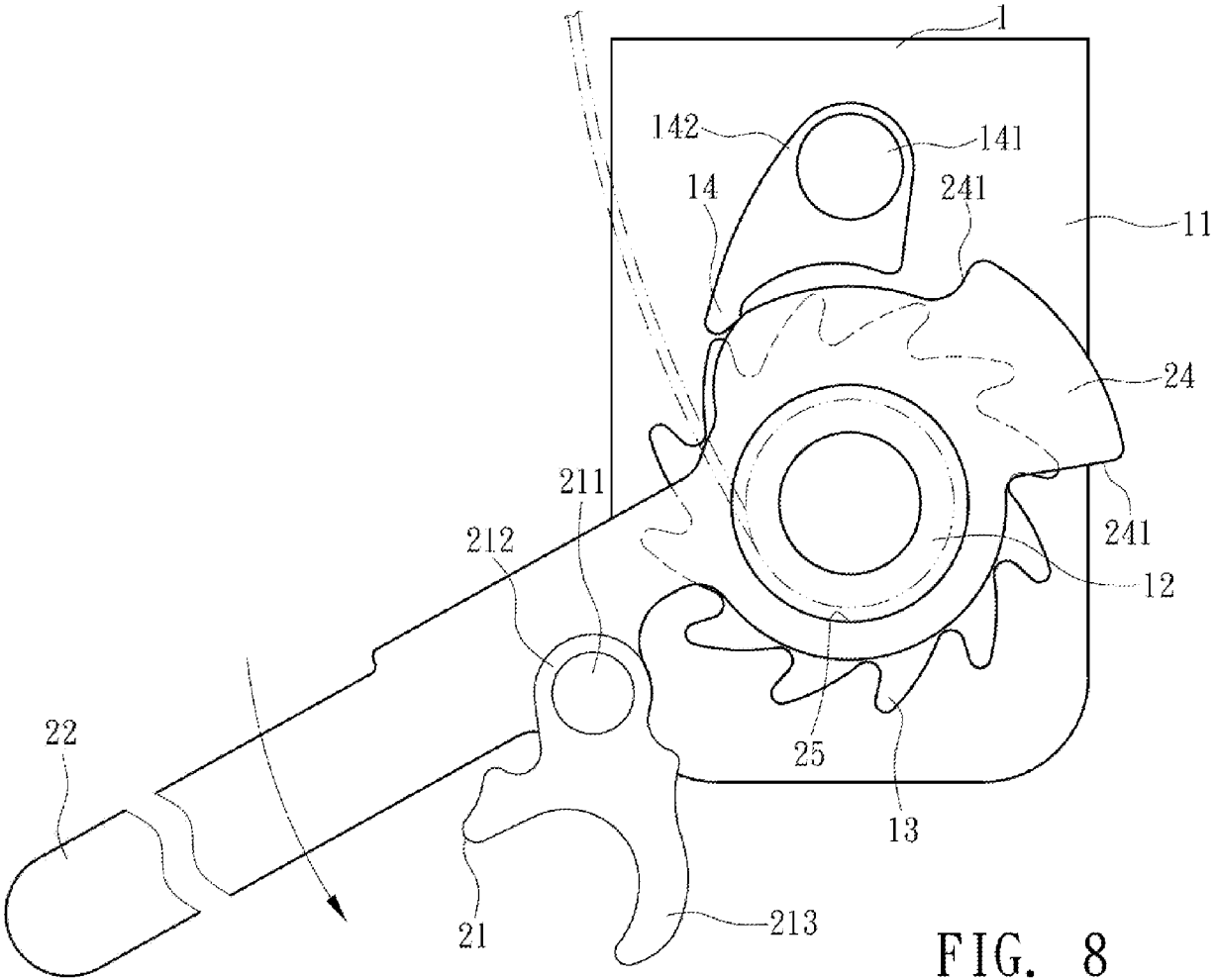
FIG. 8 is a schematic view of the driving element releasing the binding strap.

As shown in FIG. 8, to relax the binding strap 6, one first takes the driving element 2 off the rotating axle 12 and flips the driving element 2 so that the cam part 23 faces upwards relative to the holding part 22. The ratchet tooth 21 faces outwards in this case. The driving element 2 is rotated through the holding part 22. The edge of the cam part 23 pushes the tooth 14 away from the ratchet 13. Thus, the rotating axle 12 is not restricted by any element and the binding strap 6 can be quickly released.

According to the above description, one should be able to see the advantages of the invention in that the components in the base 1 are simpler than the conventional tightener. Several tighteners can be driven by a single driving element 2 to tighten or loosen the binding strap. Therefore, the cost of tighteners can be lowered to attract more consumers.

Figure 9:
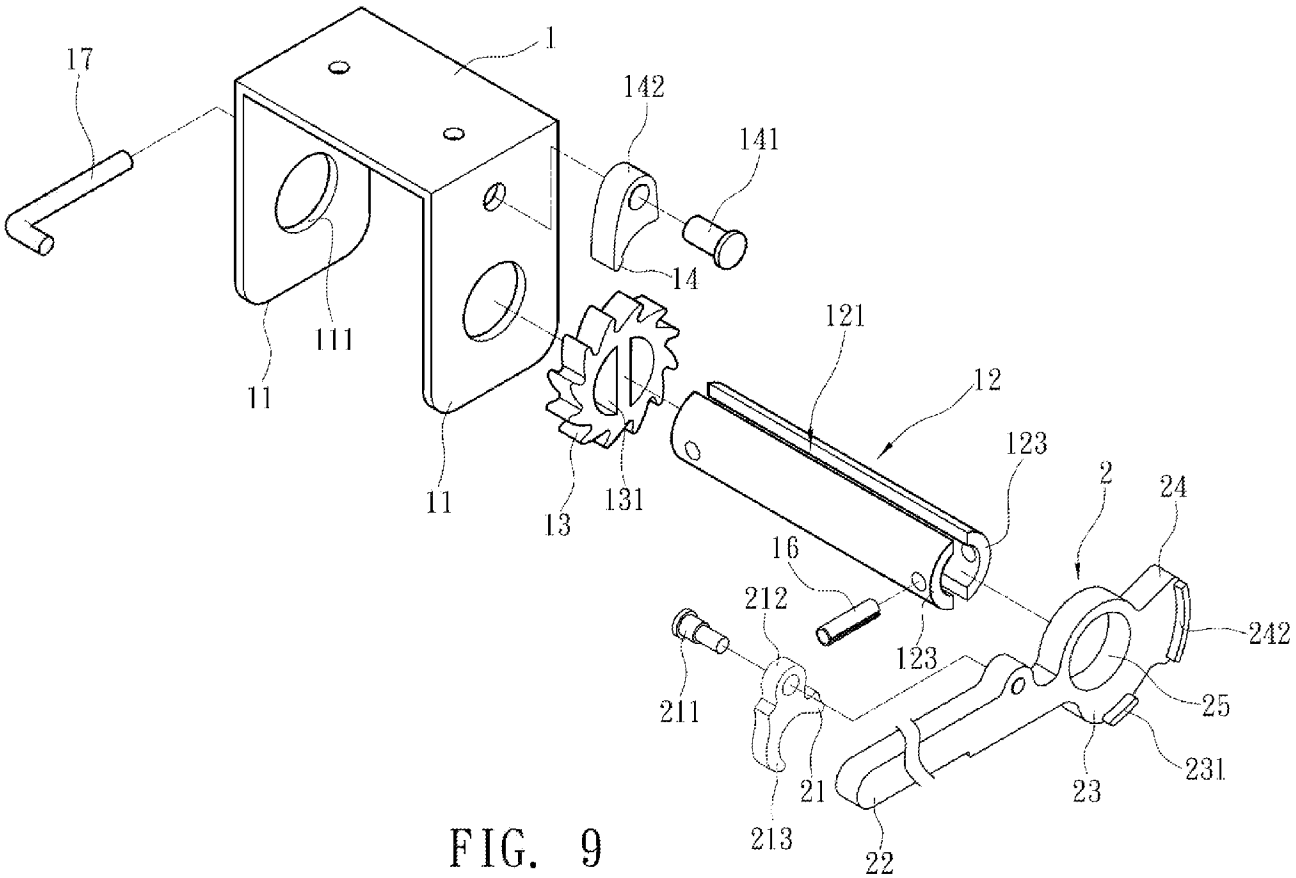
FIG. 9 is a three-dimensional assembly view of the second embodiment of the invention.
Figure 10:
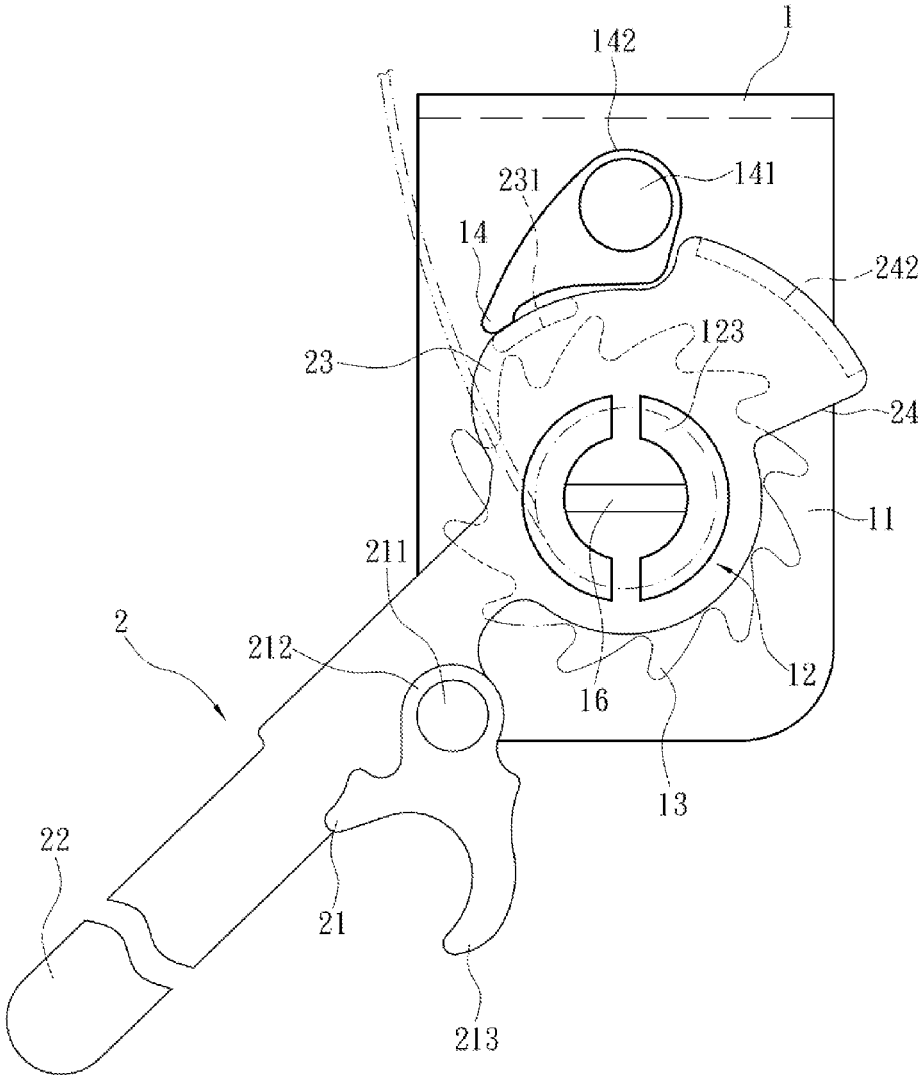
FIG. 10 is a schematic view when the driving element in the second embodiment releases the binding strap.

Of course, the invention has many other examples that only differ in details. Please refer to FIGS. 9 and 10 for a second embodiment of the invention. The horizontal surface of the ratchet 13 has two opposite semi-circular holes 131. The rotating axle 12 consists of two semi-circular boards 123 that go through the two semi-circular holes 131 of the ratchet 13. The long cutting groove 121 is formed from the gap between the two semi-circular boards 123.

The rotating axle 12 in this embodiment is positioned by a spring pin 16 on the end of the ratchet 13 outside the sidewall 11 of the base 1. The two semi-circular boards 123 outside the sidewall 11 of the base 1 on the other end is penetrated with and positioned by a bent bar pin 17.

Besides, in this embodiment the width of the ratchet 13 on the base 1 is roughly the same as that of the tooth 14. A pushing part 231 for pushing the tooth 14 outside the ratchet 13 protrudes from the cam part 23 of the driving element 2 towards the tooth 14. The blocking part 24 is protruded with a protruding section 242 towards the tooth 14 in order to block the tooth 14.

With the structure in this embodiment, the driving element 2 is mounted on the rotating axle 12 consisted of two semi-circular boards 123 using the mounting part 25, which is also a through hole. The pushing part 231 of the cam part 23 pushes the tooth 14, so that the tooth 14 disengages with the ratchet 13. The blocking part 24 blocks the tooth by the protruding section 242, thereby achieving the same effect as in the first embodiment.

Figure 11:
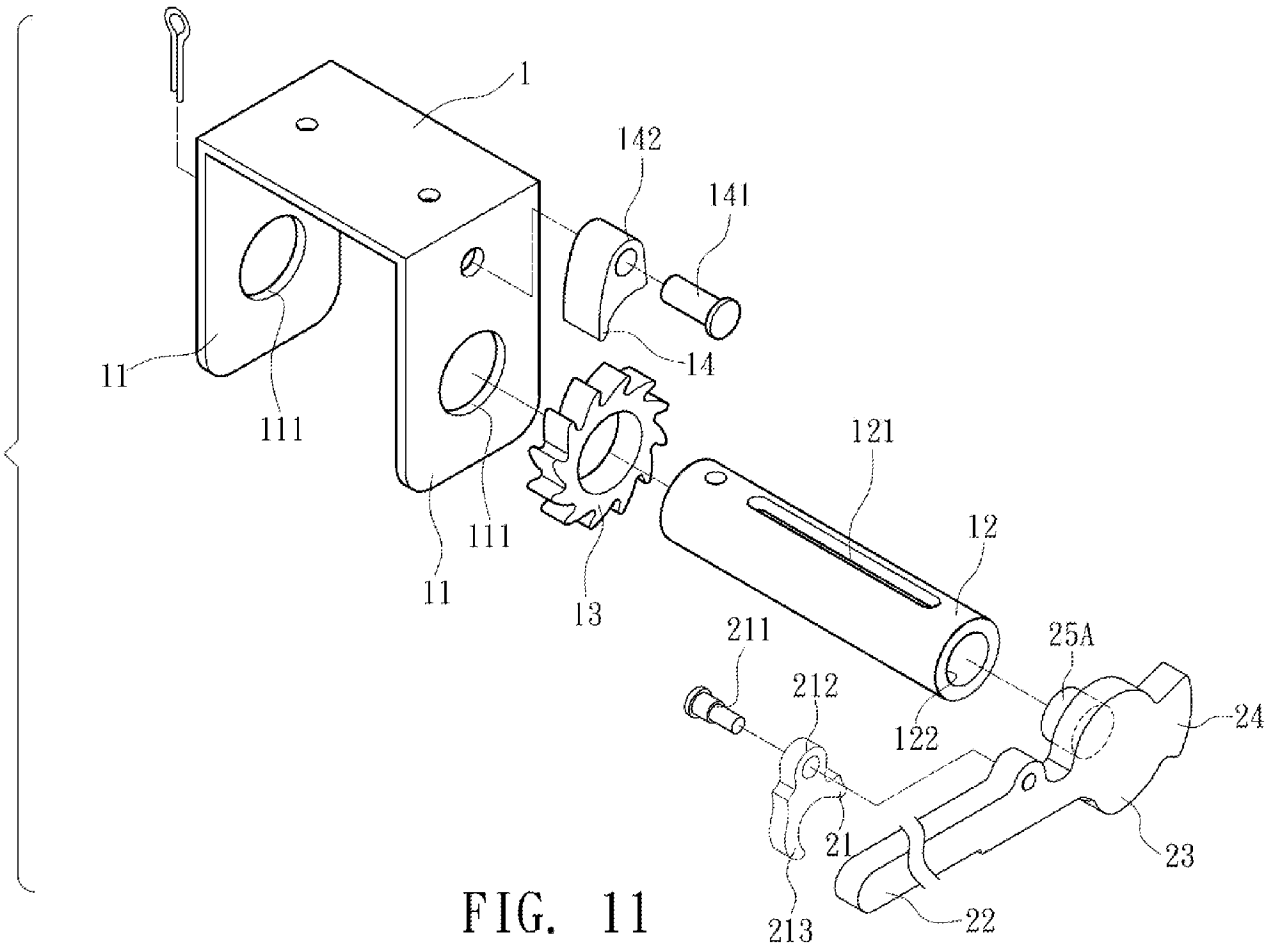
FIG. 11 is a three-dimensional exploded view of the second embodiment.
Figure 12:
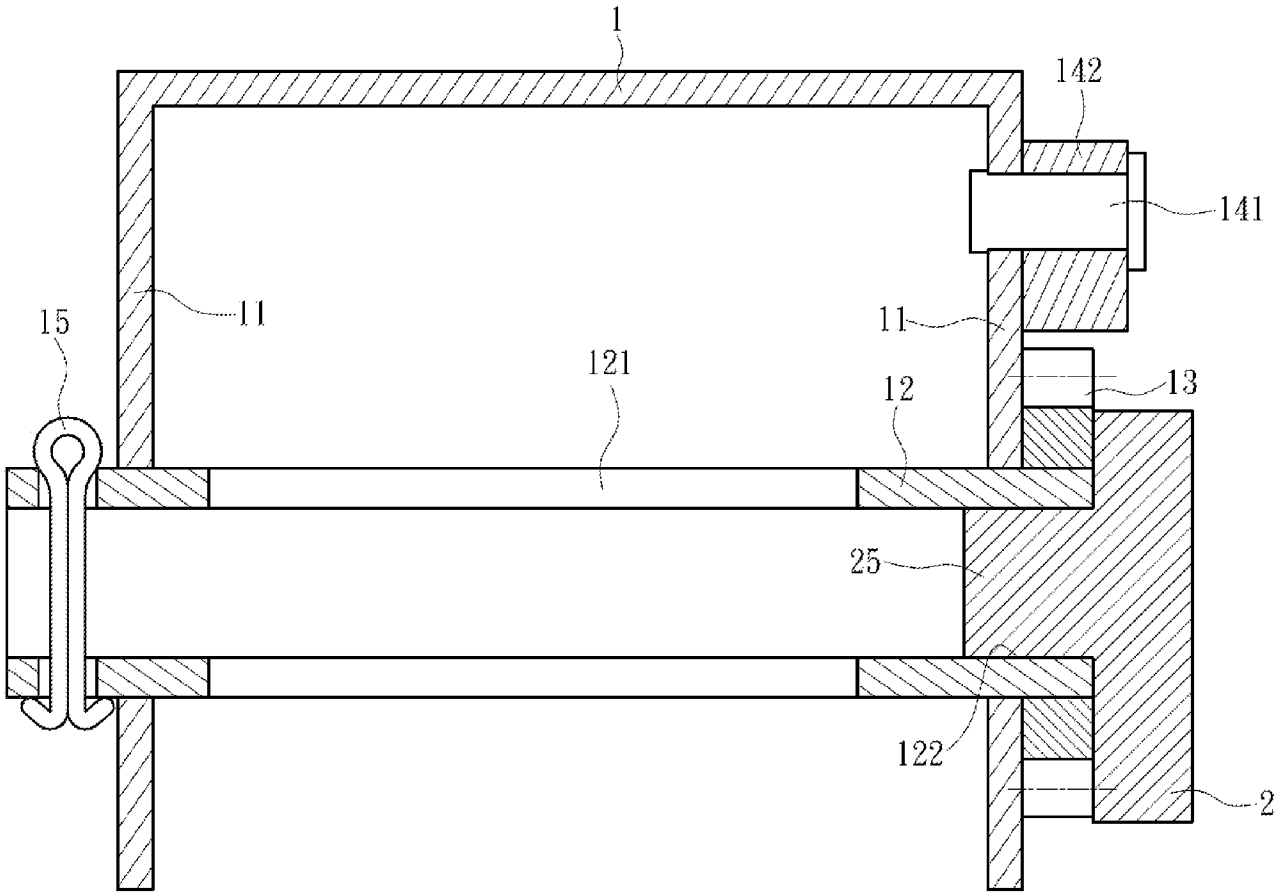
FIG. 12 is a cross-sectional view of the second embodiment.
Figure 13:
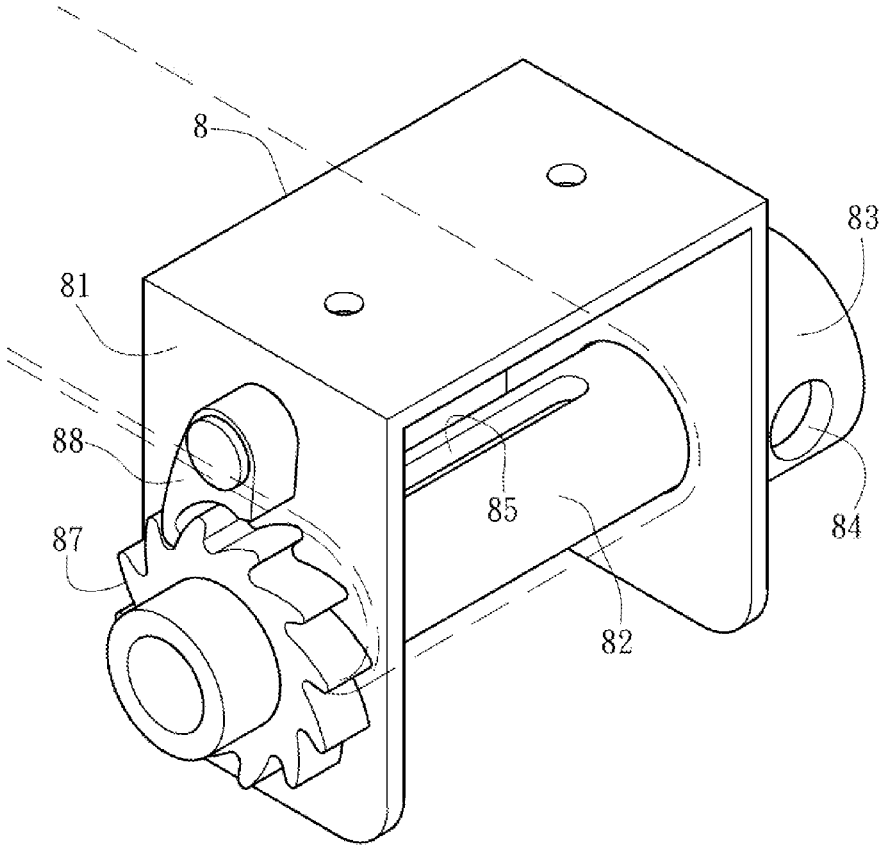
FIG. 13 PRIOR ART
FIG. 13 is a three-dimensional view of a conventional tightener.
Figure 14:
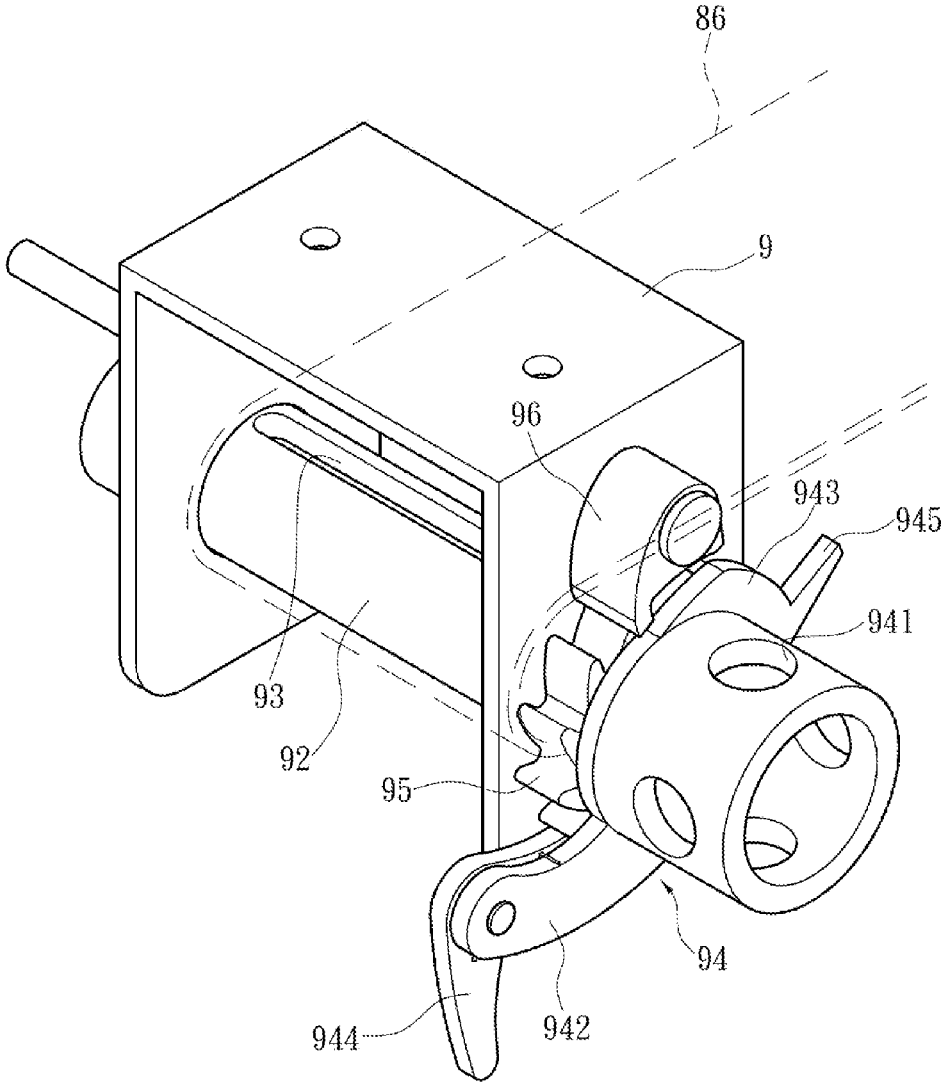
FIG. 14 PRIOR ART
FIG. 14 is a three-dimensional view of another conventional tightener.
Figure 15:
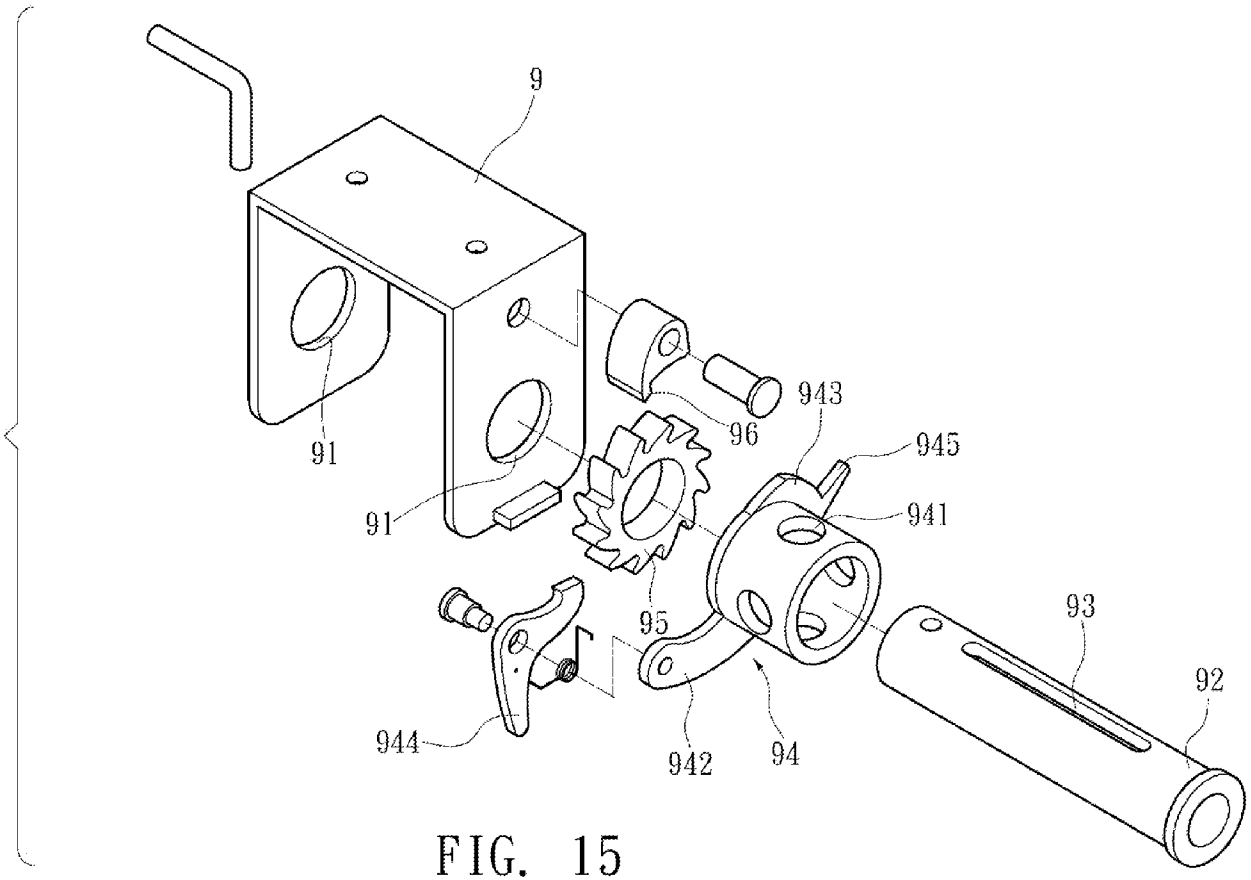
FIG. 15 PRIOR ART
FIG. 15 is a three-dimensional exploded view of FIG. 14.

Please refer to FIGS. 11 and 12 for a third embodiment of the invention. The mounting part 25A is a protruding pillar.

The rotating axle 12 has a groove part 122 on one end. The driving part 2 is disposed in the groove part 122 of the rotating axle 12 using the mounting part 25A (i.e., the protruding pillar). This also achieves the same effect of combining the driving element 2 with the rotating axle 12 as in the first embodiment.

Although the invention has been described with reference to specific embodiments, this description is not meant to be construed in a limiting sense. Various modifications of the disclosed embodiments, as well as alternative embodiments, will be apparent to people skilled in the art. Therefore, it is contemplated that the appended claims will cover all modifications that fall within the true scope of the invention.

What is claimed is:

1. A tightener for a binding strap, comprising:

a base having two opposite sidewalls, each of which has an axle hole; wherein a rotating axle goes through the axle holes on the two sidewalls, a ratchet is fixed on the rotating axle protruding from one sidewall of the base, a tooth engaging by its inner side with and limiting the ratchet to rotate in a single direction is provided on the sidewall above the ratchet, and the rotating axle in the base has a long cutting groove for the binding strap to go through; and a driving element for rotating the ratchet, the driving element being removably and coaxially mounted on one end of the rotating axle outside the ratchet and adjacent to the ratchet, wherein a ratchet tooth is pivotally disposed on the driving element to engage with the ratchet, a holding part protruding outwardly from the driving element for exertion of force, a cam part disposed on the driving element to push the tooth away from the ratchet, and a blocking part disposed on the driving element and opposite to the holding part for blocking the tooth, wherein the driving element can be removed from the rotating axle, flipped, and coaxially mounted on the rotating axle adjacent to the ratchet with the ratchet tooth being separated from the ratchet by the holding part, after the driving element being flipped the cam part pushes the tooth away from the ratchet when the driving element rotates, wherein a mounting part is disposed between the blocking part and the ratchet tooth, the driving element is coaxially mounted on the rotating axle via the mounting part along the axial direction of the rotating axle.

2. The tightener for a binding strap of claim 1, wherein the width of the ratchet on the base is smaller than the width of the tooth.

3. The tightener for a binding strap of claim 1, wherein the mounting part is a through hole and the driving element is mounted on the outer ring of the rotating axle by the through hole.

4. The tightener for a binding strap of claim 1, wherein the mounting part is a protruding pillar, the rotating axle has a groove part on its one end, and the driving element is disposed in the groove part of the rotating axle by the protruding pillar.

5. The tightener for a binding strap of claim 1, wherein the driving element has a pivotal bar, the ratchet tooth is pivotally connected to the pivotal bar using a pivotal part, a pulling part heavier than the ratchet tooth is extended from the ratchet tooth, the pulling part swings downwards due to its own weight, and the ratchet tooth protrudes towards the ratchet and engages with the ratchet when the pulling part is in its downward position.

6. The tightener for a binding strap of claim 1, wherein a pivotal bar protrudes from the sidewall of the base having the ratchet, the tooth is pivotally connected with the pivotal bar using a pivotal part, and one end surface of the blocking part blocks the side edge of the pivotal part of the tooth when the driving element is driving.

7. The tightener for a binding strap of claim 1, wherein a limiting element goes through the rotating axle on the end different from the ratchet outside the sidewall of the base, restricting the rotating axle within the axle holes on the two sidewalls.

8. The tightener for a binding strap of claim 1, wherein the horizontal surface of the ratchet has two opposite semi-circular holes, the rotating axle consists of two semi-circular boards going through the two semi-circular holes of the ratchet, and the long cutting groove is formed by the gap between the two semi-circular boards.

9. The tightener for a binding strap of claim 8, wherein the two semi-circular boards are positioned by a spring pin on the end of the ratchet outside the sidewall of the base, and the other end of the two semi-circular boards outside the sidewall of the base is penetrated through and positioned by a bent bar pin.

10. The tightener for a binding strap of claim 1, wherein the width of the ratchet on the base is roughly the same as the width of the tooth, a pushing part for pushing the tooth outside the ratchet protrudes from the cam part of the driving element towards the tooth, and a protruding section for blocking the tooth protrudes from the blocking part towards the tooth.

* * * * *